United States Patent [19]

Wagner et al.

[11] Patent Number: 4,805,496

[45] Date of Patent: Feb. 21, 1989

[54] HYDRAULIC POWER WRENCH

[75] Inventors: Paul-Heinz Wagner, Much; Alois Meyer; Karl-Richard Hirtsiefer, both of Neunkirchen-Seelscheid; Karl Beuke, Neunkirchen, all of Fed. Rep. of Germany

[73] Assignee: Paul Heinz-Wagner, Fed. Rep. of Germany

[21] Appl. No.: 22,313

[22] Filed: Mar. 5, 1987

[30] Foreign Application Priority Data

Mar. 15, 1986 [DE] Fed. Rep. of Germany ..... 3608697
Jun. 20, 1986 [DE] Fed. Rep. of Germany ..... 3620753

[51] Int. Cl.[4] ..... B25B 13/46
[52] U.S. Cl. ..... 81/57.39; 81/57.44
[58] Field of Search ..... 81/57.39, 57.44; 92/51, 92/167, DIG. 1, DIG. 4, 181 R, 181 P, 182, 106, 171, 163, 112, 110, 109, 164, 151

[56] References Cited

U.S. PATENT DOCUMENTS

| | | | |
|---|---|---|---|
| 2,758,569 | 8/1956 | Peterson | 81/57.39 |
| 2,818,314 | 12/1957 | Nicholas | 92/187 |
| 3,395,619 | 8/1968 | Grebe | 92/51 |
| 3,500,759 | 6/1968 | Potter et al. | 92/163 |
| 3,592,108 | 7/1971 | Rosaen | 92/112 |
| 3,791,242 | 2/1974 | Bartusch | 81/57.39 |
| 3,986,439 | 10/1976 | Ring | 92/181 P |
| 4,050,359 | 9/1977 | Mayer | 92/171 |
| 4,200,011 | 4/1980 | Wilmeth | 81/57.39 |
| 4,339,968 | 7/1982 | Krieger | 81/57.39 |
| 4,440,046 | 4/1984 | Hirtsiefer et al. | 81/57.39 |

*Primary Examiner*—Frederick R. Schmidt
*Assistant Examiner*—Lawrence Cruz
*Attorney, Agent, or Firm*—Diller, Ramik & Wight

[57] ABSTRACT

The power wrench comprises a housing (10) with a rearward housing member (12) which forms a protection against bursting for the hydraulic cylinder (27) arranged within the housing member (12). Through a joint (38, 40) and self-aligning, the piston (35) acts upon the lever (18) which is supported coaxially to the ring (14). The lever (18) comprises a ratchet element (17) being supported at the lever (18) by a semisperical pressure member (20). The power wrench can be submitted to extremely high hydraulic pressures without a danger to the environment.

11 Claims, 3 Drawing Sheets

HYDRAULIC POWER WRENCH

The invention refers to a hydraulic power wrench comprising

- a wrench head comprising a ring rotatably supported between two front walls for firm rotary connection with a screw to be rotated,
- a lever supported within the wrench head coaxially to the ring, which lever engages a ratchet element at the outside of the ring,
- a housing member rigidly projecting from the wrench head, which housing member contains a hydraulic cylinder,
- and a piston movable within the hydraulic cylinder, with the piston rod movably engaging the lever.

Known power wrenches of this kind (German patent application No. 34 13 202, German utility model No. 84 35 272) have a housing consisting of the wrench head and the housing member, the mentioned parts of the housing either forming a housing of one piece or being detachably interconnected. By reciprocatingly driving the piston within the cylinder, the lever engaging the ring via the ratchet element is swivelled back and forth, carrying the ring in the one rotating direction and moving back in the other rotating direction without taking the ring along. As a result of the movable engagement of the piston rod with the lever there is no need to swingingly support the cylinder; instead, the cylinder bore can form an integral part of the housing. It is also known to produce the cylinder seperately from the housing and to support it flexibly at the rear wall of the housing (German Laid-open No. 34 13 202). In this case, the housing member accomodating the cylinder is considerably larger than the cylinder so that the cylinder can perform swivelling motions within the housing member. Substantially, the housing member has only the object of preventing persons from being hurt by the movement of the cylinder.

There is further known a hydraulic power wrench (German patent application No. 34 16 881) with unilateral pressure action of the cylinder. The cylinder is movably arranged while the piston is stationary in relation to the housing member. The piston comprises a holed tube encircled by a coil spring driving the cylinder into the pull-back position. By the hydraulic pressure, the hollow piston of the cylinder within the housing member, which cylinder engages the lever, is moved and subsequently carried back in the pressureless state by the force of the spring.

The known power wrenches are operated with hydraulic pressures ranging up to about 850 bar. Using such high pressures the power wrench can be given smaller dimensions, while, however, there is a danger of the cylinder tearing or breaking due to the high pressure. This represents a considerable danger. For instance, ruptures can originate in the cylinder wall because of hardly recognizable defects in the material.

It is the object of the invention to create a power wrench of the initially mentioned type that has small dimensions and can be operated with a high hydraulic pressure with no danger to the environment in case of a flaw in the material.

According to the invention, the object is solved by the housing member being formed as a protection against bursting and comprising a channel the wall of which surrounds the hydraulic cylinder at a distance substantially constant over its length, while the hydraulic cylinder and the channel are at least approximately coaxially positioned to each other.

In the power wrench according to the invention, the housing member surrounding the cylinder forms a burst protection encompassing the cylinder at a small radial distance. The cylinder receives the hydraulic force existing in its interior and is capable of resisting the force by itself. If the cylinder wall breaks or tears apart, the housing member captures the particles cracking off and leaking hydraulic oil so that no particles are flung into the environment. The housing member has walls thick enough to fulfill this function. The radial distance of the housing member from the cylinder is so small that particles loosening upon the bursting of the cylinder are immediately caught and do not gain a notable kinetic energy. The housing member is provided for loosely guiding the cylinder without, however, supporting or reinforcing it against the hydraulic pressure. The cylinder forms a unit on its own within the housing member, and it is supported by it only in axial direction to lead off the reaction force brought about when swivelling the lever.

The outer diameter of the hydraulic cylinder is preferably by less than 1 mm smaller than the inner diameter of the channel. In this manner, the cylinder can move sufficiently for freely adapting to the respective-direction of the force while the free space does not become so large that parts, cracking off are given a too large kinetic energy.

According to an advantageous embodiment of the invention, the piston rod is encircled by a coil spring the one end of which presses against the piston and the other end of which presses against an inner shoulder of the hydraulic cylinder. Thereby, a simple and inexpensive construction is obtained, and the space within the housing member is entirely used without unnecessary empty spaces, thus also reducing the constructional dimensions of the power wrench.

According to another aspect of the invention, there is provided that the ratchet element is supported immediately at the lever through a spherical or hemispherical pressure member. By the pressure member, an independent and omnidirectional adjustment of the ratchet element to the lever is effected, while there is secured a fullfaced engagement between the ratchet element and the pressure member as well as between the pressure member and the lever, thus avoiding local pressure peaks. Since only the pressure member is provided between the ratchet element and the supporting surface of the lever, the length of the lever can be reduced as compared with a normally usual elbow lever. Reducing the lever is possible because of using very high pressures in the cylinder. The reduced length of the lever contributes as well to cutting back the dimensions of the apparatus.

Subsequently, embodiments of the invention are explained in greater detail with respect to the drawings, in which.

Figure 1:
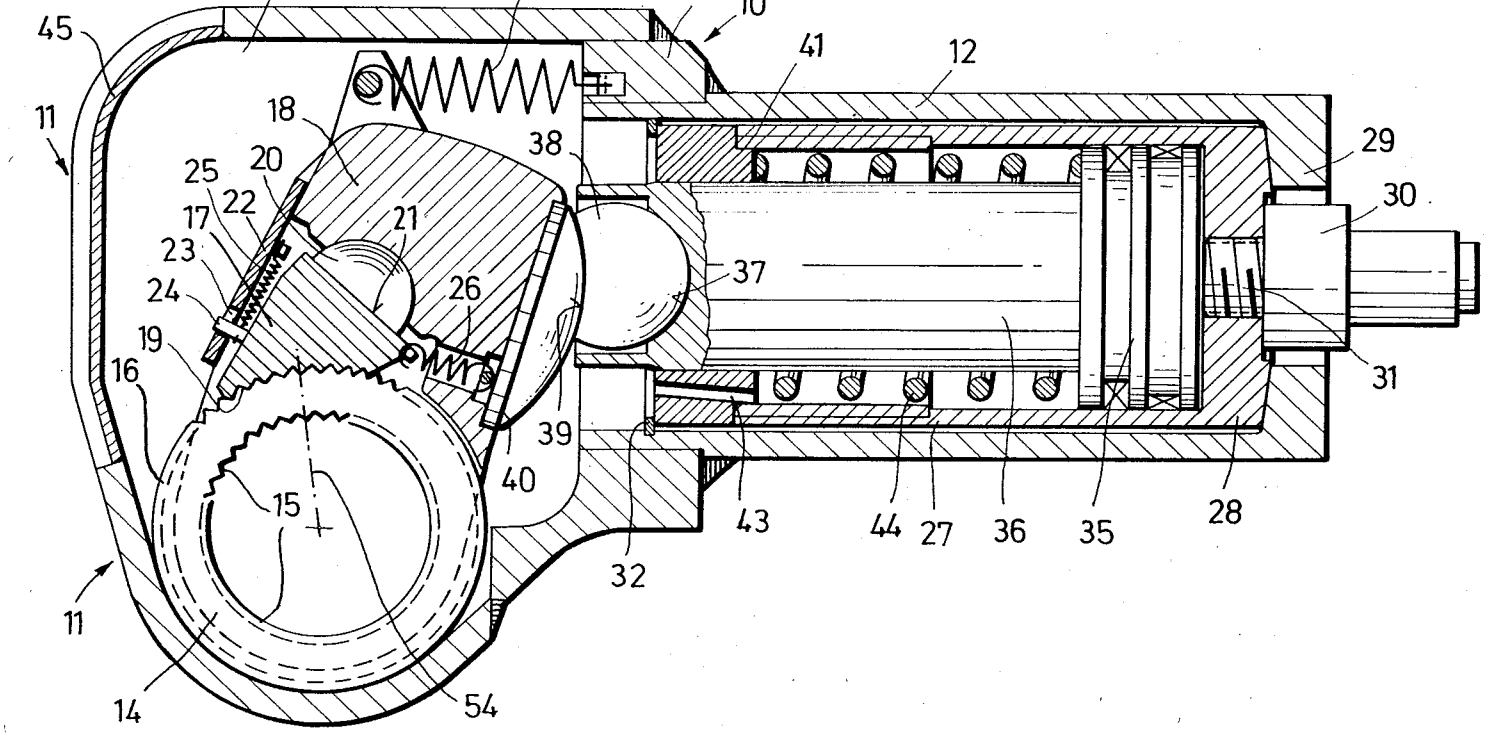
FIG. 1 is a longitudinal section of a power wrench with a retracting spring.

The power wrench illustrated in FIG. 1 comprises a housing 10 consisting of the wrench head 11 and the cylindrical housing member 12 undetachably connected to it. The wrench head 11 has parallel front walls 13 only one of which is shown in the drawing.

Between two bores of the front walls 13, which bores are positioned in axial relationship and in alignment to each other, there is supported a ring 14. The ring 14 comprises an inner profile 15 into which a shaft (not shown) can be inserted. This shaft has an outer profile corresponding to the inner profile 15. The shaft can be inserted from both sides of the housing. The shaft protrudes to one or both sides of the housing. At the protruding end, it is provided with an inner or an outer profile so as to be firmly rotatably connectable to the screwhead and its button die, respectively.

With the external toothing 16 of the ring 14 there cooperates a ratchet element 17 consisting of a wedge-shaped ratchet shoe and being arranged in a recess of lever 18. Lever 18 is supported coaxially to the ring 14, and it can be swivelled in relation to this ring around the common axis. By means of a concavely formed toothed surface 19, the ratchet element 17 can engage with the external toothing 16 of the ring 14. At its rear end, ratchet element 17 supports a substantially semispherical pressure member 20 which is fitted into a spherical recess of lever 18. The plain rear surface of pressure member 20 fullfacedly abuts the plain rear surface 21 of ratchet element 17. The pressure member 20 can also slide on a rear surface 21. This rear surface extends under an acute angle to that tangent of ring 14 which cuts through the radial center line 54 of toothed surface 19. The ratchet element 17, being supported by the spherical surface of pressure member 20, is self-adjusting in all directions to the external toothing 16, so that upon engagement of the teeth of toothing surface 19 with the external toothing 16 canting or tilting of the ratchet element 17 is prevented. The ratchet element 17 is oriented in such a manner that it lifts off from the external toothing 16 when ring 14 is moved into the one rotating direction (counterclockwise according to the drawing) so that ring 14 is freely rotatable in this direction, whereas the ratchet element 17 blocks the ring by its toothing when ring 14 is turned into the opposite direction (clockwise).

To lever 18 there is fastend a plate 22 covering the recess to the outside and comprising a guiding slot 23 for a pin 24 protruding from ratchet element 17. Plate 22 serves for limiting the swivelling movement of ratchet element 17 and for guiding it when lifting off from ring 14. To plate 22 there is fixed a spring 25 the end of which engages pin 24 and which pulls the outer end of ratchet element 17 nearly tangentially to ring 14. One of the one hand, spring 25 pulls ratchet element 17 against pressure member 20, and on the other hand, it exerts a small force component on the outer end of the ratchet element, the force component tending to lift off the outer end of toothing surface 19 from external toothing 16.

The inner end (facing, housing member 12) of ratchet element 17 is engaged by a spring 26 which is fastened to lever 18 and pulls the ratchet element into the direction of housing member 12 so as to bring the inner end of toothing surface 19 into engagement with the external toothing 16. Also spring 26 extends approximately tangentially to ring 14.

Housing member 12 forms a longitudinal interior space with its cross section preferably constant over its length. The axis of the interior space extends rectangular to the axis of ring 14 and is distanced from this axis so that the whole of the one-pieced housing 10 is substantially L-shaped. Within the cylindrical interior space of housing member 12 the hydraulic cylinder 27 is arranged. This cylinder consists of a tube being closed by a cover 28 at its rear end. Cover 28 is supported at its rear end at the front wall 29 of housing member 12. A connecting member 30 extends at a radial distance through a bore of this front wall 29. The end 31 of connecting member 30 is bolted in a screw bore of cover 28. Thus, connecting member 30 is sealingly fastened to cover 28 and within limits movable along with hydraulic cylinder 27 with respect to housing member 12.

The outer diameter of hydraulic cylinder 27 is smaller than the inner diameter of housing member 12 so that cylinder 27 within housing member 12 has a small radial allowance and can freely adjust itself without bending moments occuring. The movement of cylinder 27 towards the wrench head 11 is limited by a stopper 32, e.g. a spring ring, being fitted into an annular groove in the interior of housing member 12.

The wrench head 11 is undetachably connected to housing member 12 through a collar 33. At least one spring 34 is connected to collar 33, engaging the end of lever 18 and pulling the lever towards cylinder 27.

The piston 35 is displaceable within the hydraulic cylinder 27. The piston rod 36 protrudes from the piston 35 towards the wrench head 11. At the end of piston rod 36, a ball 38 is fastened is a spherical recess 37, having at its outer side a capshaped mold 39 forming a concave spherical surface. the convex spherical surface of a spherical segment 40 fastened to lever 18 presses against the mold 39. The diameter of mold 39 corresponds to that of spherical segment 40 so that the two spherical surfaces are in full surface contact.

The face wall of the hydraulic cylinder 27 that is averted from cover 28 comprises a guide bush 41 which forms part of the cylinder and in which piston rod 36 slides. Further, an air duct 43 leads through the guide bush 41. At the inner side of guide bush 41 there is propped up coil spring 44 the other end of which presses against piston 35 and tends to move that piston into its retracting position where it abuts cover 28. Coil spring 44 is assisted by the coil (or a plurality of coils) 34. Therefore, spring 44 can be made smaller than without spring 34. It is also possible to push back the piston only by one of coils 44 or 34. In this case, the other coil of coils 44 or 34 would be omitted. This leads to smaller dimensions of the apparatus.

All of the parts arranged within housing 10 can be mounted through an opening of wrench head 11 that is closed by cover 45.

When operating the power wrench, oil is pressed, under high pressure of e.g. 800 bar through the connecting member 30 into the hydraulic cylinder 27, thereby compressing the coil 44 and swivelling the lever 18 in the carrying direction in which the ratchet element 17 carries ring 14 along. At the subsequent release of pressure, coil spring 44 pushes the piston 35 into the retracting position again, and the spring 34 pulls the lever 18 into the retracting position, too. At the same time, the ratchet element 17 lifts off from the external nal toothing 16, thus not carrying along the ring 14. The springs 25 and 26 secure that the pressure member 20 is held at the lever 18 by the ratchet element 17 but is freely adjustable with regard to the lever. Moreover, spring 34 provides that the balls 3R and 40 remain in abutment to each other.

Since there is only a unilateral pressure exerted on the piston/cylinder unity, only one connecting member is required which can be inserted into the cover. There is no need for a weakening or a transverse perforation of the hydraulic cylinder 27.

The housing member 12 only serves for loosely guiding the hydraulic cylinder 27 but does not receive hydraulic forces itself. The housing member functions as a protection against bursting for preventing material particles from escaping into the environment if the hydraulic cylinder breaks. The embodiment according to FIG. 2 largely corresponds to that according FIG. 1 so that the following description is restricted to the explanation of the differences. According to FIG. 2, the wall of the hydraulic cylinder 27 comprises radial bores 47 in the vicinity of the guide bush 41 surrounding the piston rod 36. By these radial bores, the cylinder space 48 on the side of the piston rod is connected to the free space 49 between the hydraulic cylinder 27 and the housing member 12.

In addition to the connecting member 30 for the working pressure, a further connecting member 50 is provided in the cover 28, being connected with a hydraulic auxiliary pressure-source via a pressure tubing. There is no direct connection between the connecting member 50 and the working space of cylinder 27. A radial oil duct 51 formed within cover 28 leads from connecting piece 50 to ring space 49. The return stroke of piston 35 is effected by the auxialiary pressure passing from connecting piece 50 via oil duct 51, annular iroove 49 and bores 47 into the return stroke space 48. The auxiliary pressure for the return stroke of the piston is much smaller than the working pressure transmitted to connecting piece 30.

As compared to the spring retraction, the hydraulic retraction of the piston has the advantage that the apparatus can also be employed in situations demanding large return stroke forces, e.g. when the tubing transmitting the working pressure is very long.

During the return stroke, the pressure head within the long working pressure tubing has to be overcome to guide the piston back into its end position in a short time. In the embodiment according to FIG. 2, the housing member 12 is advantageously used for supplying the auxiliary pressure to the cylinder chamber 48. Sealings 52, 53 seal off the ring space 49 and the path of the auxiliary pressure oil against the environment.

Figure 2:
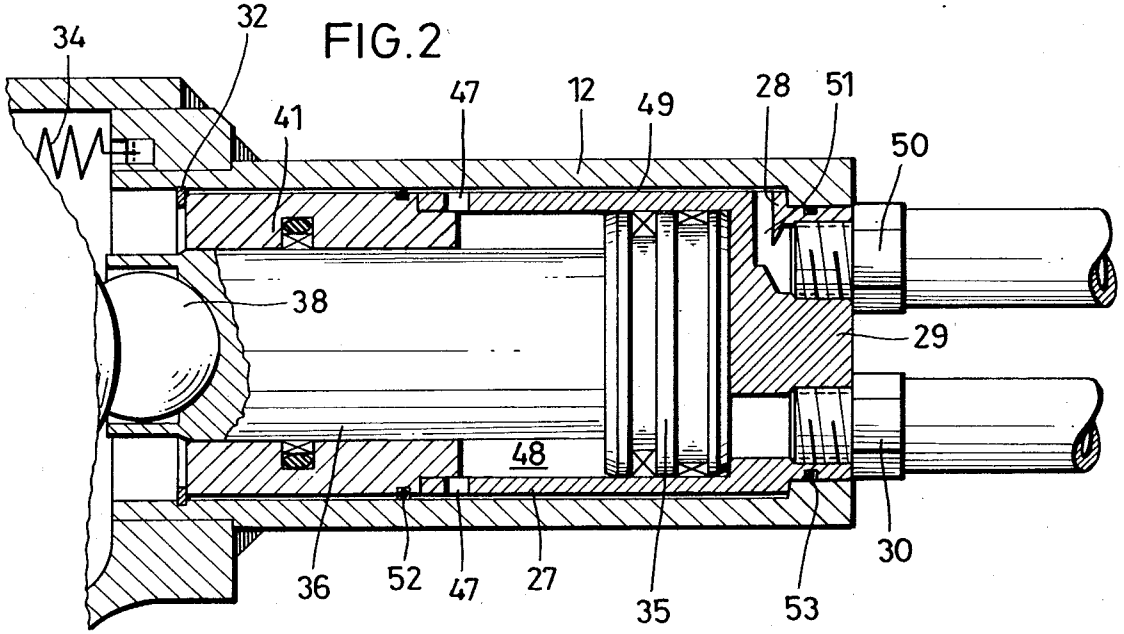
FIG. 2 shows another embodiment with hydraulic retraction of the piston.
Figure 3:
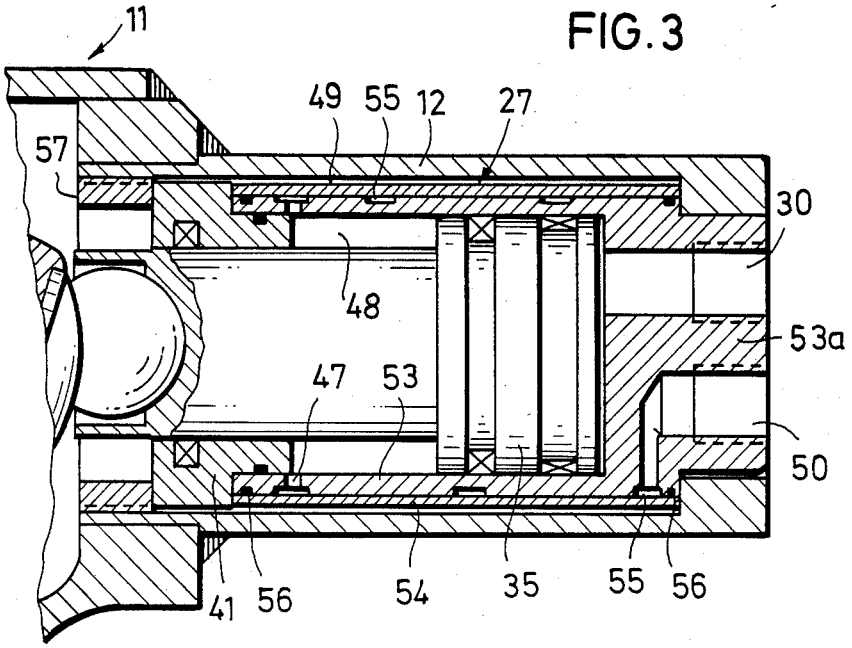
FIG. 3 shows a further embodiment with hydraulic retraction of the piston, the cylinder being a unit in its own right.

The embodiment according to FIG. 3 is largely similar to that according to FIG. 2 so that the subsequent description is limited to explaining the differences. As FIG. 3 shows the hydraulic cylinder 27 consists of the cylinder member 53 integrally formed with the rear front wall 53*a*, at its front end being open and closed by guide box 41, and the sealing sleeve 54 surrounding cylinder member 53. The cylinder member 53 is provided with at least one helical groove 55 to the radial the one end of the groove being connected bores 47 and the other end being connected to connecting member 50. In this manner, fluid connection is effected from connection 50 via groove 55 and bores 47 to cylinder space 48. The inner wall of sealing sleeve 54 is appropriately set on the circumference of cylinder member 53 so that hydraulic fluid can pass lengthwise of the cylinder through the groove 55 only. Between cylinder member 53 and sealing sleeve 54, sealing rings 56 are provided at both end of these parts. Instead of the helical groove 55 also a purality of lengthwise grooves can be provided, being interconnected at both ends by annular grooves. The sealing sleeve 54 has a smaller wall thickness than the cylinder member 53 which for the most part receives the hydraulic pressure in the other cylinder space being averted from cylinder space 48. Nevertheless, the cylinder bush 54 supports the mechanical reinforcement of the hydraulic cylinder 27 against radial expansion. The free space 49 is provided between the sealing sleeve 54 and the inner wall of housing member 12. Thus, the hydraulic cylinder 12 can freely adjust itself within housing member 12.

Mounting the hydraulic cylinder 27 is performed from the interior of wrench head 11. For axially fixing the hydraulic cylinder there is provided (alternatively to the spring ring 32 in FIG. 1) a threaded ring 57 with an external thread to axially support guide bush 41. Supporting the hydraulic cylinder 27 at the opposite end is achieved by the front wall 53*a* pressing against the front wall of housing member 12.

The free space 49 serves for accommodating the oil leaking from the hydraulic cylinder 27 and particles possibly flying off in case of the cylinder breaking. By supporting the hydraulic cylinder 27 in the described manner, a limited movement of this hydraulic cylinder and an appropriate adaptation to the respective direction of the force is made possible. The hydraulic cylinder 27 can be prefabricated as a whole and be inserted into the housing member 12 out of the wrench head 11.

Figure 4:
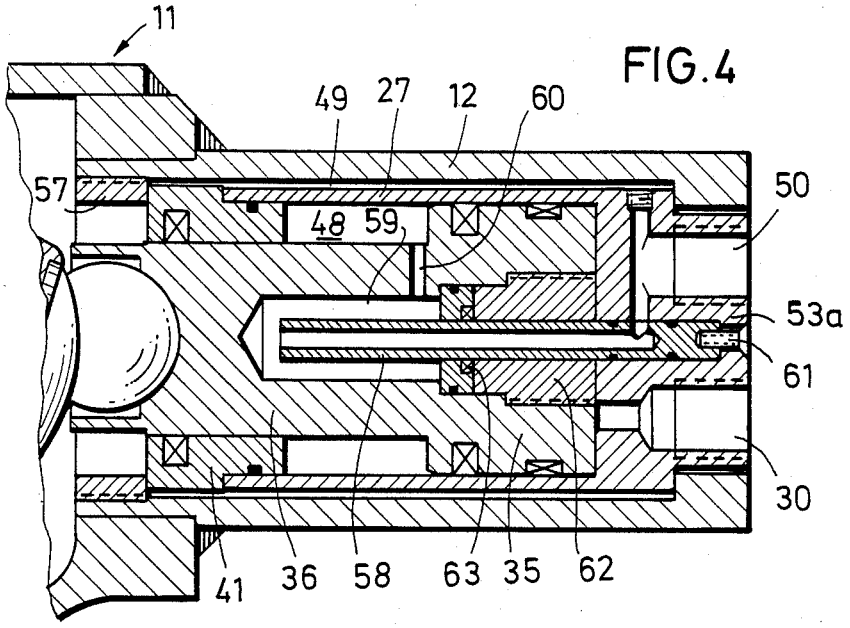
FIG. 4 illustrates a still further embodiment with hydraulic retraction of the piston, the retracting pressure being transmitted by passing through the piston.

The embodiment according to FIG. 4 widely corresponds to that of FIG. 3; accordingly, only the differences will be demonstrated hereafter. As FIG. 4 shows, the cylinder 27 is a thin-walled cylinder limited at its rear end by the integrally formed front wall 53*a*, the front end being closed by the guide bush 41 through which the piston rod 36 extends.

At the front wall 52*a* of cylinder 27 there is attached a tube 58 extending through the piston 35 and ending in a cavity 59 inside the piston rod 36. The cavity 59 is connected to the cylinder chamber 58 through a radial bore 60. The rear end of tube 58 is connected to connecting member 50 which is alternatingly connectable to a return pipe and a low pressure pipe. The tube 58 is fixed to the front wall 53*a* by a screw 61 and reaches through a guiding member 62 screwed into the interior of piston 35 and surrounding the tube so as to be slidable on this tube. Inside the guiding member 62 there is arranged a sealing 63 for sealing off the cavity 59 against the (right) main cylinder chamber.

If the piston 35 is pushed forward towards the wrench head 11 by hydraulic pressure at connection 30, pressure fluid evades from cylinder chamber 48 through bore 60, cavity 59 and tube 58 to connection 50. During the return stroke of piston 35, connecting member 50 is submitted to a comparatively sma11 hydralic pressure while connecting member 30 is pressureless. Thus, piston 35 is carried back.

In the embodiment according to FIG. 4, there is again arranged an annular groove 49 between cylinder 27 and housing member 12 so as to provide a space for accomodating oil and particles in case of a bursting of cylinder 27, and to obtain a non-jammed adjustment of the cylinder to the respective direction of the force while avoiding detrimental bending moments.

In all of the embodiments according to FIG. 2 to 4, the conduit extending lengthwise of tne cylinder and connecting cylinder chamber 48 to connecting member 50 necessitates no considerable radial enlargement of the cylinder and the housing member 12, respectively, thus keeping the radial dimensions of housing member 12 small. Therefore, the operability of the hydraulic power wrench, especially at places that are not easily accessible, is improved.

The cylinders of the embodiments according to FIG. 1 to 4 are exchangeable without any alteration at the housing. This enables the apparatus to be quickly converted from spring retraction of the piston to hydraulic retraction.

I claim:

1. A hydraulic power wrench comprising a wrench head including a ring, means for rotatably supporting said ring within said wrench head, a lever, means for supporting said lever within said wrench head to impart rotation to said ring through cooperative ratching elements, a housing member projecting from said wrench head, said housing member containing a hydraulic cylinder, a piston movable within said hydraulic cylinder and having a piston rod for moving said lever, said housing member being a protective sheet protective against damage should said hydraulic cylinder burst, said housing member including an interior generally cylindrical surface defining a generally annular channel with an exterior generally cylindrical surface of said hydraulic cylinder, said interior and exterior generally cylindrical surfaces being spaced from each other a substantially constant radial distance, said interior and exterior generally cylindrical surfaces being in generally coaxial relationship to each other, means for preventing axial movement of said hydraulic cylinder relative to said member, said hydraulic cylinder and piston cooperatively defining a high pressure chamber, means for introducing hydraulic fluid under relatively high pressure into said high pressure chamber, and said annular chamber being constructed and arranged so as to be at all times isolated hydraulically from the high pressure chamber and the high pressure hydraulic fluid therein.

2. The hydraulic power wrench as defined in claim 1 wherein said annular channel has a radial dimension preferably less than 1 mm.

3. The hydraulic power wrench as defined in claim 1 wherein said annular channel has opposite axial end portions adjacent to and remote from said wrench head, and said axial movement preventing means are at said adjacent end portion between said housing member and said hydraulic cylinder for holding said hydraulic cylinder against movement in a direction away from said remote end portion.

4. The hydraulic power wrench as defined in claim 1 including a coil spring surrounding said piston rod, a bushing carried by said hydraulic cylinder at said adjacent end portion, said bushing have a bore slidably receiving said piston rod, and said spring having opposite ends respectively bearing against said bushing and said piston.

5. The hydraulic power wrench as defined in claim 1 including bores in said hydraulic cylinder, and means placing said generally annular channel in fluid communication with an exterior source of pressure fluid.

6. The hydraulic power wrench as defined in claim 1 including spring means for biasing said lever against said piston rod to urge said piston in a direction toward said remote end portion.

7. The hydraulic power wrench as defined in claim 1 wherein said hydraulic cylinder includes a cylindrical member surrounded by a generally cylindrical sealing sleeve, at least one groove between said cylindrical member and said sealing sleeve extending generally lengthwise of said hydraulic cylinder, said hydraulic cylinder and piston defining a hydraulic chamber, and means placing said groove is fluid communication with said hydraulic chamber.

8. The hydraulic power wrench as defined in claim 1 including a hydraulic chamber defined between said hydraulic cylinder and said piston, a cavity in at least one of said piston and said piston rod, means placing said cavity in fluid communication with said hydraulic chamber, a tube opening into said cavity, and means placing said tube into fluid communication with a fluid pressure source.

9. A hydraulic power wrench comprising a wrench head, a ring, means for rotatably supporting said ring relative to said wrench head, a lever, means for supporting said lever within said wrench head to impart movement to said ring, a ratchet element engaged by said lever, said ratchet element having ratchet teeth for engaging ratchet teeth of said ring, a housing member projecting from said wrench head, said housing member including a hydraulic cylinder, a piston and piston rod within said hydraulic cylinder, said piston rod engaging said lever, curved pressure surface means between said lever and said ratchet element for transmitting forces from said lever to said ratchet element, first spring means between said ratchet element and said lever for imparting retracting forces to said ratchet element generally tangentially to said ring, and second spring means between said lever and said ratchet element for imparting biasing forces to said ratchet element in a direction toward said piston.

10. The hydraulic power wrench as defined in claim 1 wherein said hydraulic cylinder includes an end wall and axially opposite thereto an axially opposite end closed by an annular ring, said piston rod is mounted for reciprocal movement in an opening of said annular ring and locking ring means for preventing movement of said annular ring in a direction away from said hydraulic cylinder end wall.

11. The hydraulic power wrench as defined in claim 10 including an axial peripheral face defined by said hydraulic cylinder remote from said hydraulic cylinder end wall, and said annular ring is abuttingly confined between said axial peripheral face and said locking ring means.

* * * * *